United States Patent [19]

Ohtaki et al.

[11] 3,983,591

[45] Oct. 5, 1976

[54] CLEANING DEVICE

[75] Inventors: Shinshiro Ohtaki; Hiroshi Ogino, both of Tokyo, Japan

[73] Assignee: Shinshiro Ohtaki, Tokyo, Japan

[22] Filed: Aug. 23, 1973

[21] Appl. No.: 391,166

[30] Foreign Application Priority Data

Aug. 27, 1972 Japan ..... 47-85492
Aug. 27, 1972 Japan ..... 47-85493

[52] U.S. Cl. ..... 15/28; 15/103; 15/220 A

[51] Int. Cl.[2] ..... A46B 13/02

[58] Field of Search ..... 15/28, 29, 103, 220 A

[56] References Cited

FOREIGN PATENTS OR APPLICATIONS 1,545,864 10/1967 France ..... 15/220 A
856,978 12/1960 United Kingdom ..... 15/220 A
888,344 1/1962 United Kingdom ..... 15/220 A

*Primary Examiner*—Edward L. Roberts
*Attorney, Agent, or Firm*—Ladas, Parry, Von Gehr, Goldsmith & Deschamps

[57] ABSTRACT

Two cleaning elements, each having a magnet and a brush, are arranged outside and inside of a windowpane. The cleaning elements attract each other by magnetic force through the windowpane and they move simultaneously when one of them is moved in operation. This cleaning device is convenient and safe for cleaning windowpanes of higher buildings because cleaning of both sides of the windowpanes can be done at one time working indoors.

1 Claim, 7 Drawing Figures

CLEANING DEVICE

FIELD OF THE INVENTION

This invention relates to a novel cleaning device. More particularly, this invention relates to an automatic cleaner suitable for cleaning windowpanes, comprising a pair of co-ordinated cleaning elements having a magnet and a brush, which are positioned outside and inside of the windowpane, respectively and move simultaneously by magnetic force.

BACKGROUND OF THE INVENTION

Cleaning or polishing of windowpanes of high buildings such as skyscrapers depends on manual labor. Such work requires a large number of well-experienced workers, and cleaning the outside of the windowpanes is very dangerous. Accordingly, development of a device which frees men from such dangerous tasks has long been awaited. Furthermore, as cleaning of the windowpanes is usually conducted at both sides by different persons, some portions of either side may sometimes remain uncleaned.

The object of the present invention is to provide a novel cleaning device, particularly suitable for cleaning windowpanes, for example, of higher buildings.

SUMMARY OF THE INVENTION

According to the present invention, there is provided a cleaning device, comprising a pair of co-ordinated cleaning elements having a magnet and a brush which, are positioned outside and inside respectively of an object to be cleaned such as a windowpane, and can move simultaneously by magnetic force.

In the annexed drawings which are shown to illustrate the preferred embodiments of the present invention:

Figure 5:
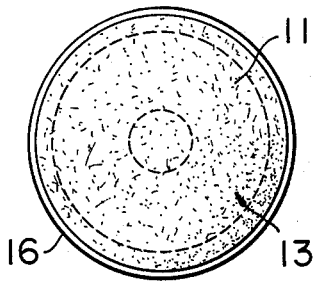
Figure 6:
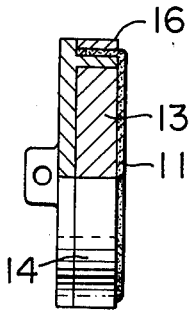
Figure 4:
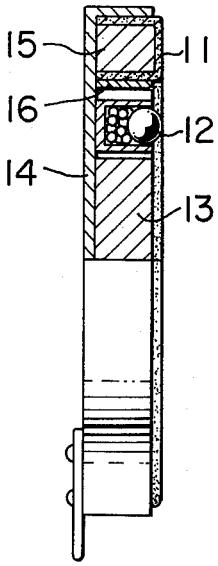

FIG. 4 its enlarged side view partially in section;

FIG. 5 is the front view of another preferred embodiment of a cleaning element and;

FIG. 6 the side view thereof partially in section; and

Figure 7:
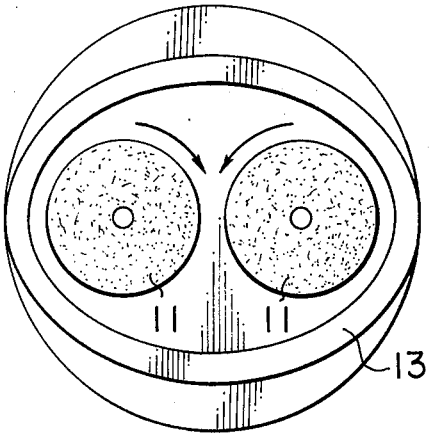

FIG. 7 is the front view of further preferred embodiment of a cleaning element.

Figure 2:
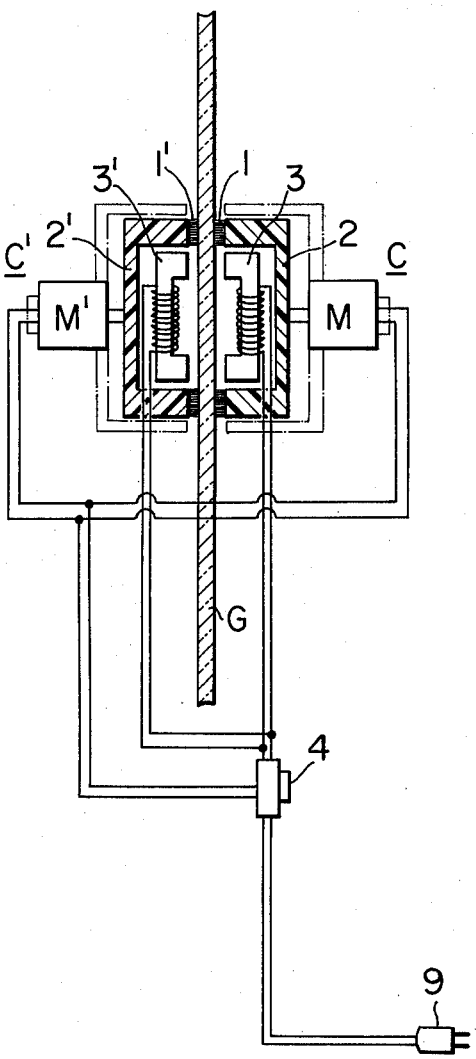
FIG. 2 is the enlarged side view partially in section of the principal members constituting the cleaning device as shown in FIG. 1.
Figure 1:
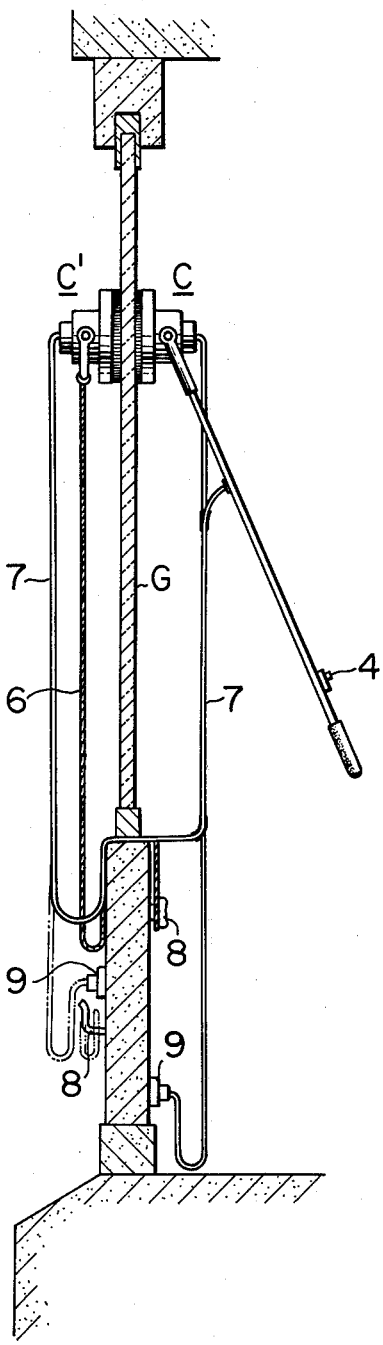
FIG. 1 is a schematic side view of one example of the preferred embodiment of the cleaning device of the present invention.

In FIGS. 1 and 2, a pair of cleaning elements C and C′ are arranged outside and inside of the windowpane G, respectively. The cleaning elements are held tightly together on the windowpane G through magnetic force by means of the electromagnets 3 and 3′. When the switch 4 connecting to the plug socket 9 and mounted on the handle 5 which is placed inside of the windowpane G, is turned on, magnetic field is produced so that the cleaning elements C and C′ attract each other. At the same time, the motors M and M′ begin to rotate. Driven by these motors, the brushes 2 and 2′ made of, for example, wool or urethane foam, also begin to rotate. Then, by means of the handle 5, the cleaner C is moved freely on the inner side of the windowpane G, whereby the cleaner C′ is induced to move likewise on the outer side thereof. Thus, the two sides of the windowpane G can be cleaned by operating from only one side. By the attracting force between the electromagnets 3 and 3′, the cleaners C and C′ are held tightly together, but they can be slided on the windowpane very freely and smoothly. For the purpose of safety, in practical applications, the outside cleaner C′ is preferably fastened at one end of the rope 6 which is fixed at the other end on the fixing means 8 or otherwise hanged on a suitable hanger. The cleaner C′ may also have iron plates, which are easily attractable by the electromagnet 3, equipped at suitable portions, in place of using the electromagnet 3′. If the plug sockets and fixing means for ropes are equipped at both indoor and outdoor sides, cleaning may be conducted without opening the windowpanes. Armored gondolas coventionally used may of course be employed for cleaning by means of the cleaner of the present invention. Furthermore, each cleaning element may also be used separately for cleaning, for example, iron plates or the like.

Figure 3:
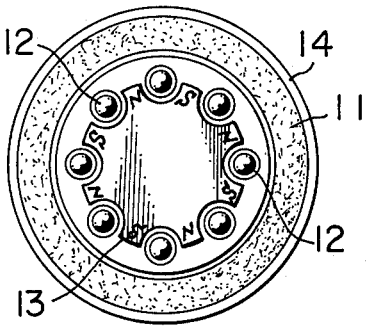
FIG. 3 is the front view of a preferred embodiment of a cleaning element.

Referring now to another preferred embodiment of the cleaning element of the present invention as shown in FIGS. 3 and 4, permanent magnets and ball bearings are encased in the cleaning element. They serve to slide the cleaning element more smoothly. As shown in FIGS. 3 and 4, brush 11 is inserted in a roll around the supporting frame 15 in close contact with the internal circumference of the case 14 (e.g. plastic case) and fixed with a ring frame 16. In the internal side of said ring frame 16 are equipped ball bearings 12 and strong permanent magnets consisting of ferrite magnetic material, preferably strong barium magnetic material, are placed in the center thereof. This cleaning element may be operable in pairs as shown in FIG. 1, but no electric source is needed because permanent magnet is employed. For accomplishment of favorable magnetic attraction of the pair of cleaners, the cleaning element may have multiple magnetic poles as shown in FIG. 3. These multipole magnets are not only excellent in attractive force, but also easy in separation on account of N—N and S—S repelling force effected by rotating one of the cleaning element.

FIGS. 5 and 6 show another preferred embodiment of the cleaning element of the present invention. In the center of the case 14, the permanent magnet 13 is placed, whereupon is covered the brush 11 which is fixed by the ring frame 16.

FIG. 7 shows a cleaning element which has two rotating brushes. By increasing the number of brushes per each cleaning element, cleaning operation becomes easier because stability in operating the cleaning device is improved thereby.

Various attachments may also be mounted on the cleaning device of the present invention. For example, an attachment for blowing air to remove the dust accumulated around the brush, an attachment for providing cleaning or polishing agents, etc. may be provided in any desired manner.

We claim:

1. A cleaning device, comprising a pair of co-ordinated cleaning elements each having a magnet and a brush, and which, on being positioned outside and inside respectively of an object to be cleaned, can move simultaneously by magnetic force, and wherein each cleaning element has electromagnet means at its center and rotatable brush means positioned therearound.

* * * * *